US005437730A

United States Patent [19]

Flores

[11] Patent Number: 5,437,730

[45] Date of Patent: Aug. 1, 1995

[54] PROCESS FOR CLEANING GENERALLY CYLINDRICAL OBJECTS USING A CLEANING COMPOUND IMPREGNATED IN AN ENLONGATED LACE

[76] Inventor: Robert L. Flores, 16125 Promontory Rd., Chino Hills, Calif. 91709

[21] Appl. No.: 281,603

[22] Filed: Jul. 28, 1994

Related U.S. Application Data

[63] Continuation-in-part of Ser. No. 85,096, Jul. 2, 1993.

[51] Int. Cl.[6] ..... B08B 7/04; B08B 3/00; D04H 1/58; B32B 9/04

[52] U.S. Cl. ..... 134/6; 134/18; 134/29; 134/40; 428/289; 428/260

[58] Field of Search ..... 134/6, 18, 25.4, 29, 134/40; 428/289, 290, 447, 913

[56] References Cited

U.S. PATENT DOCUMENTS 4,725,489 2/1988 Jones et al. ..... 428/289
4,753,844 6/1988 Jones et al. ..... 428/288

*Primary Examiner*—George F. Lesmes
*Assistant Examiner*—Kathryne E. Shelborne
*Attorney, Agent, or Firm*—Edgar W. Averill, Jr.

[57] ABSTRACT

A polishing lace comprising a roll of thin fabric having a central axis and a free end. The roll of thin fabric is impregnated with a cleaning and disinfecting compound. A thin object, such as the spoke of a wheel of a motor vehicle is cleaned by forming at least one loop around the spoke and pulling the ends of the impregnated ribbon back and forth to clean and polish the spoke. Preferably a second not impregnated fabric take is utilized to remove any polish residue from the spoke. A container holding a roll of the polishing lace has a scissors portion for cutting off a length of tape from the roll.

1 Claim, 2 Drawing Sheets

PROCESS FOR CLEANING GENERALLY CYLINDRICAL OBJECTS USING A CLEANING COMPOUND IMPREGNATED IN AN ENLONGATED LACE

CROSS REFERENCES TO RELATED APPLICATIONS

This application is a continuation in part of applicant's pending application Ser. No. 08/085,096 filed Jul. 2, 1993.

BACKGROUND OF THE INVENTION

The field of the invention is metal polishing and cleaning/disinfecting cylindrical objects. The invention relates more particularly to devices for cleaning cylindrical objects such as the spokes of a wheel of a motor vehicle and also the cleaning and disinfecting of objects made from tubing such as wheelchairs, hospital beds, gurneys and the like.

The wheels of a motor vehicle often become coated with materials which detract from their natural shine. Often, the material which coats the spokes is difficult to remove such as road tar. Furthermore, since the spokes can often be viewed from both sides of the wheel, it is important that all surfaces be cleaned for optimum appearance.

Paramedics are required to clean and disinfect emergency equipment which often becomes stained with blood and other fluids. This job is often time consuming because such fluids can dry and become very difficult to remove. Typically, hand held cloths are used for this process.

Polishing rags which are impregnated with a polishing compound are known. One such cloth is shown in U.S. Pat. No. 4,683,001. The cloth is designed to provide a wax coat without the need for buffing. A lotion applicator utilizing a lotion carrying strip is shown in U.S. Pat. No. 4,759,652. It is suggested for use for applying lotions to various parts of the human body.

Most thin cylindrical objects are tediously cleaned by a flat polishing cloth which has been covered with a cleaning/waxing compound and squeezed and moved lengthwise along the spokes. Unfortunately, this cleans only two opposite sides of the spoke and it is very difficult to do a thorough job with such materials.

SUMMARY OF THE INVENTION

The present invention is for a polishing lace comprising a length of thin fabric having a free end. The thin fabric is impregnated with a cleaning/waxing compound or a cleaning/disinfecting compound. Preferably, the length of thin fabric is formed on a roll with a central axis and the roll is held in a container which includes means for cutting a length from the roll to a desired length. Preferably, the container has a pair of rolls, one impregnated with a cleaner/wax and the other being just fabric for removing the cleaner/wax from the polished spoke or other cylindrical object. The process of the present invention includes the steps of impregnating a thin roll of fabric tape, cutting it to a manageable length, forming at least one loop around the object to be polished and grasping the two ends of the length and pulling them back and forth to provide a rubbing action on all surfaces of the cylindrical object.

DESCRIPTION OF THE PREFERRED EMBODIMENTS

Figure 1:
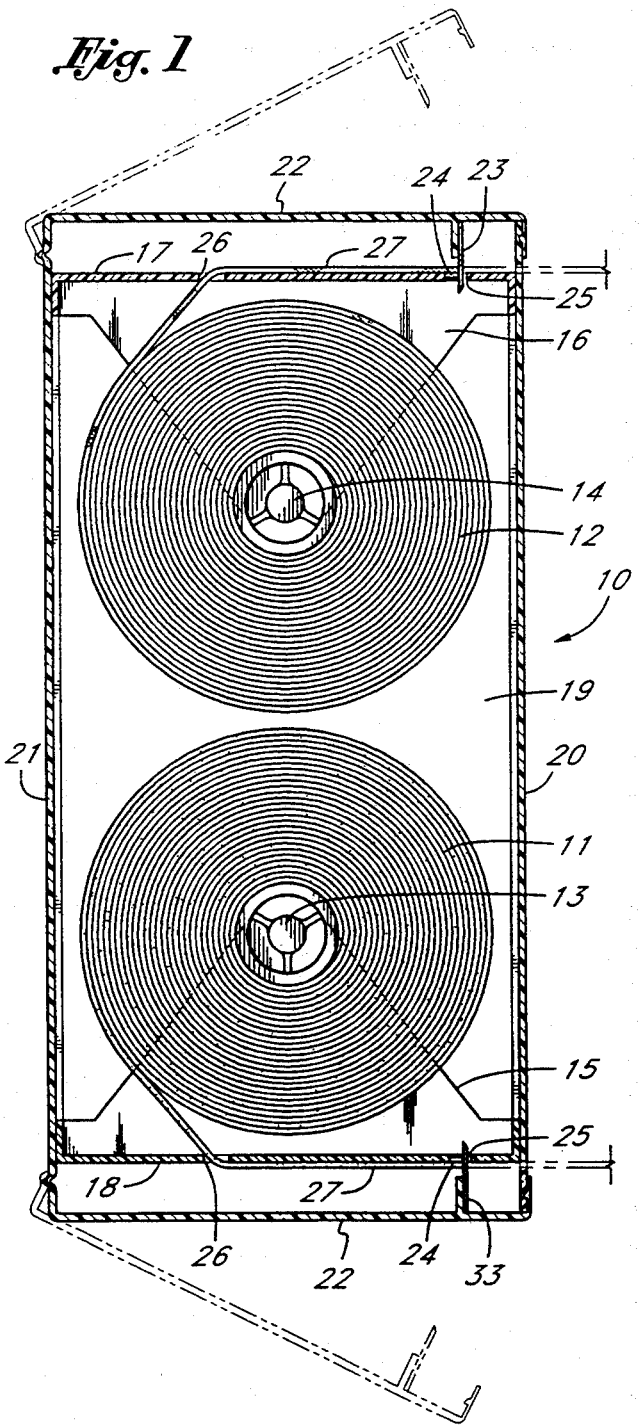
FIG. 1 is a cross sectional front view of a container holding two rolls of polishing lace of the present invention.
Figure 3:
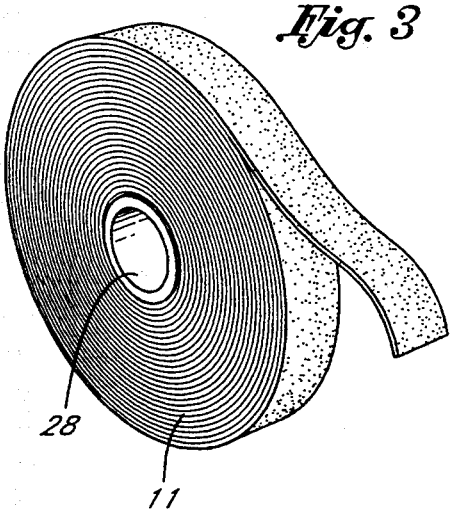
FIG. 3 is a perspective view of one of the rolls of FIG. 1.
Figure 4:
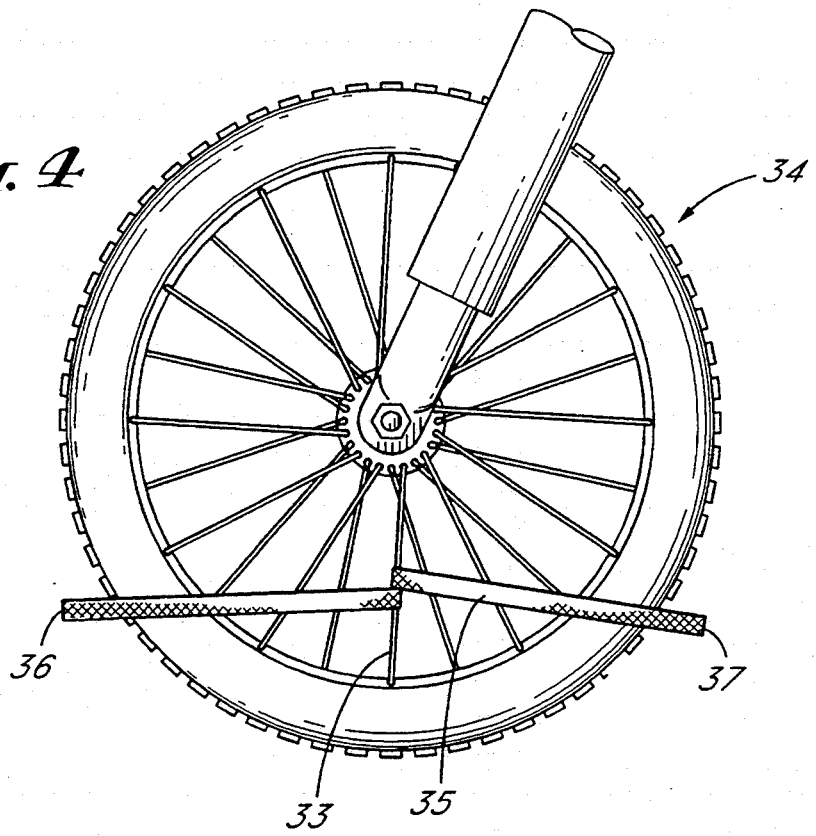
FIG. 4 shows a motorcycle front wheel with a length of the roll of polishing lace of FIG. 2 wrapped around a spoke thereof.

A container 10 is shown in cross sectional side view in FIG. 1 and has a roll of thin fabric impregnated with a cleaner/wax indicated by reference character 11. This roll is shown in perspective view in FIG. 3. The roll is impregnated with a material which is dependent upon the job at hand. For instance, for a motor vehicle use the roll would be impregnated with a cleaner/wax composition of the type which has a mild abrasive, a cleaner and a wax blended together. Such material is typically sold as an auto or chrome polishing compound. The impregnating material should be selected so that it does not dry out unduly upon standing. Alternatively, the roll may be dipped in a disinfecting material such as an alcohol, quaternary ammonium compound or other cleaning agent. Other disinfectant materials include germicide compounds such as N-alkyl dimenthyl ammonium chloride or N-alkyl dimenthyl ethyl benzyl ammonium chloride. The disinfectant material sold under the trademark Sporicidin is a recommended solution with which to dip the fabric.

Figure 2:
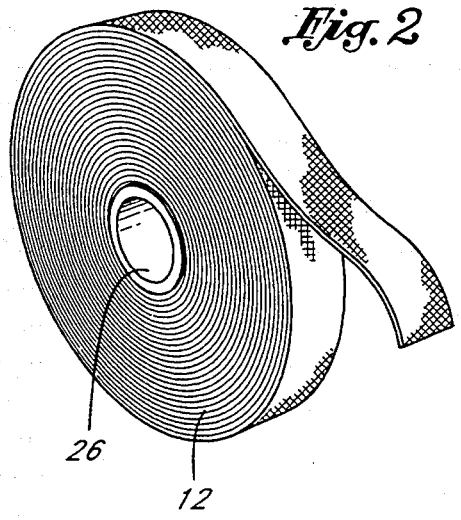
FIG. 2 is a perspective view of one of the rolls of FIG. 1.

A second roll 12 is shown in container 10 and is a row of thin fabric which is not impregnated and is merely a polishing cloth. This roll 12 is also shown in perspective view in FIG. 2.

Both rolls 11 and 12 have a central axis 13 and 14 respectively. Central axis 13 is rotatingly held on a support member 15 within container 10. Similarly, central axis 14 is held on a support member 16 within container 10.

Container 10 has a top 17, a bottom 18, a front not shown, a back 19, a right side 20 and a left side 21. A hinged cover 22 holds a knife blade 23 which cooperates with a blade 24, held adjacent an opening 25. The roll of fabric 12 exits through an opening 26 in top 17 and passes above top 17 and over opening 25. In use, hinge cover 22 is opened, that portion of the fabric indicated by reference character 27, is grasped and pulled outwardly. Next, the hinged cover 22 is closed, thereby cutting the tape by the scissor's action of blades 23 and 24. Hinged cover 22 securely closes the container 10 to minimize loss of volatile components of the cleaner wax.

The roll of polish/cleaner impregnated tape is identically cut and thus, the same reference characters have been used for the bottom cover. Preferably rolls 11 and 12 are formed around central tubes 28 and 29 respectively. These tubes facilitate the turning of the rolls within container 10.

Figure 5:
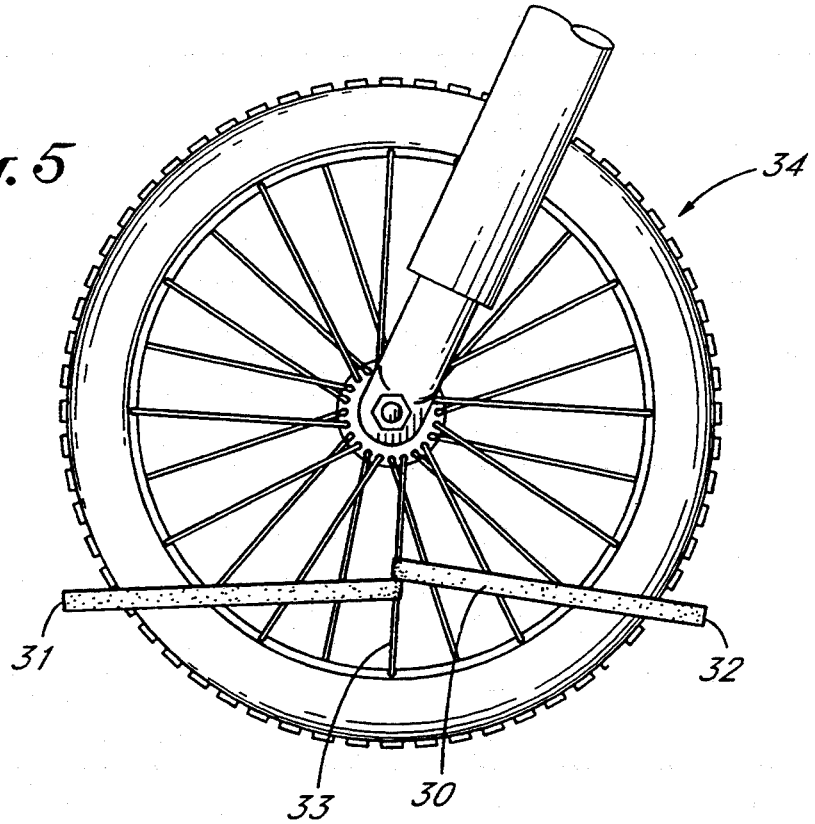
FIG. 5 is a side view of a motorcycle front wheel having a length of the roll of polishing cloth of FIG. 3 wrapped around the spoke thereof.

In use, a length of polishing cloth is cut from roll 11 and said length is indicated by reference character 30 in FIG. 5. This length has a first end 31 and a second end 32. This length 30 is wrapped around spoke 33 of wheel 34 and the first and second ends are grasped and pulled back and forth to completely rub and polish spoke 33. Length 30 leaves a residue of polishing compound and wax on spoke 33. Thus, a second length 35 is cut from roll 12 and has a first end 36 and a second end 37. This is also wrapped around spoke 33 and ends 36 and 37 are grasped and pulled back and forth to remove any remaining polish and cleaner from spoke 33 leaving a highly polished spoke.

The width of the length of polishing cloth is very dependent upon the end use. For thin spokes the width may be not unlike a heavy duty cloth shoe lace which typically has a width of about ¼". For larger cylindrical objects such as the tubular material used in a wheelchair, a 1" to 2" width is contemplated. For yet a larger diameter tubular article such as a brass rail, a width up to 3" is contemplated. The length of the roll of material is preferably many feet. It is contemplated, however, that individual lengths such as 2' or 3' might be packaged in a sealed pack for single use applications.

The material from which the polishing lace is formed should be cotton or other highly absorbent fabric. For some cleaning operations the material can be braided steel to provide a highly abrasive cleaning operation. Alternately, synthetic or natural fibers could be used. While a roll of material is shown in the drawings, an unrolled aggregation of tape is likewise contemplated, although a roll is the preferred method of retaining the tapes, it may be removed without angling. The lace may be woven in the manner of conventional webbing or may be a non-woven fibrous material.

The word "cleaning" is used in this application in the broad sense to include polishing, disinfecting and of course, general cleaning.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A process for cleaning/disinfecting generally cylindrical objects comprising:

impregnating an elongated roll of absorbent fabric tape with a cleaning compound to form an elongated cleaning ribbon;

cutting a length of said elongated cleaning ribbon to form a length of cleaning lace;

forming at least one loop around a generally cylindrical object to be cleaned said loop being intermediate along said length of cleaning lace and leaving a first extending length and a second extending length; and grasping the first and second extending lengths of said length of cleaning lace and pulling the cleaning ribbon back and forth to clean the generally cylindrical object.

* * * * *